United States Patent [19]

Imoto et al.

[11] Patent Number: 4,702,222

[45] Date of Patent: Oct. 27, 1987

[54] IGNITION SYSTEM FOR MULTI-CYLINDER 4 CYCLE ENGINE

[75] Inventors: Kosuke Imoto; Kazutoshi Koyama, both of Saitama, Japan

[73] Assignee: Honda Giken Kogyo Kabushiki Kaisha, Tokyo, Japan

[21] Appl. No.: 784,253

[22] Filed: Oct. 4, 1985

[30] Foreign Application Priority Data

Oct. 5, 1984 [JP] Japan ..... 59-151005[U]
Oct. 6, 1984 [JP] Japan ..... 59-210288

[51] Int. Cl.[4] ..... F02P 9/00
[52] U.S. Cl. ..... 123/643; 123/640
[58] Field of Search ..... 123/643, 640, 490

[56] References Cited

U.S. PATENT DOCUMENTS 3,621,826 11/1971 Chrestensen ..... 123/643
4,170,207 10/1979 Boyama ..... 123/643

FOREIGN PATENT DOCUMENTS 55-96364 7/1980 Japan ..... 123/643

*Primary Examiner*—Andrew M. Dolinar
*Attorney, Agent, or Firm*—Lyon & Lyon

[57] ABSTRACT

An ignition system for four cycle engines generates a first pulse when the crankshaft revolves by a first setting angle from a base position. The second pulse is generated when the crankshaft revolves to a second setting angle which is larger than the first setting by the angle difference between cylinders. The third pulse is generated at the position of a third setting angle which is between the first setting angle and the second setting angle in the position of the crankshaft when the crankshaft revolves twice. The generation of the first and second pulses is stopped or inhibited during the generation of the third pulse, allowing the first pulse to fade away.

5 Claims, 8 Drawing Figures

IGNITION SYSTEM FOR MULTI-CYLINDER 4 CYCLE ENGINE

FIELD OF THE INVENTION

This invention relates to an ignition system for 4 cycle engines.

DRAWINGS

BACKGROUND

Figure 1:
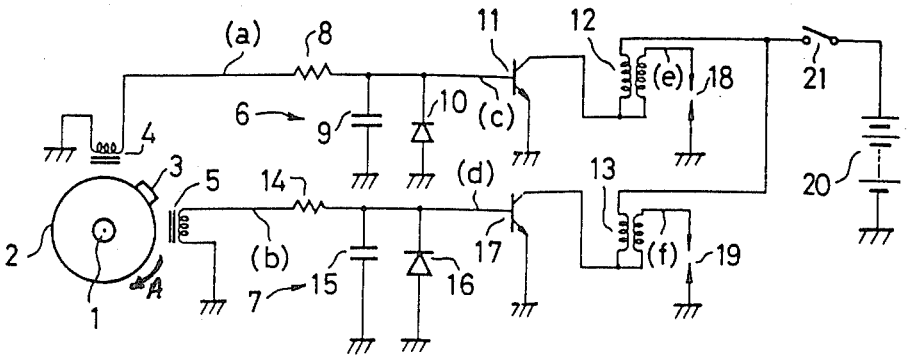
FIG. 1. PRIOR ART
FIG. 1 shows an existing ignition circuit.

An example of an existing ignition system for a 2 cylinder 4 cycle 90 degree V type engine is shown in FIG. 1. In this FIGURE, an iron piece 3 is mounted convexly on rotor 2 which is connected directly to the crankshaft 1 of the engine. Magnet pick-ups 4 and 5 are mounted near rotor 2 and spaced apart 90 degrees. Iron piece 3 and magnet pick-ups 4 and 5 generate pulse signals when the rotor 2 revolves. Ignition driving circuits 6 and 7 are connected to the output terminals of magnet pick-ups 4 and 5. Ignition driving circuit 6 comprises resistor 8, condenser 9, diode 10 and transistor 11. Input pulse signals are differentiated by resistor 8 and condenser 9, and the differentiated output is supplied to the base of transistor 11. Diode 10 protects the transistor against a negative voltage input. The emitter of transistor 11 is grounded. The collector provides the output terminal of the ignition driving circuit 6. That output terminal is connected to one side of a primary and secondary coil of an ignition coil 12. Ignition driving circuit 7 comprises resistor 14, condenser 15, diode 16 and transistor 17, like ignition driving circuit 6. The output terminal of ignition driving circuit 7 is provided by the collector of transistor 17 and is connected to the one side of a primary and secondary coil of an ignition coil 13. The other end of each secondary coil of ignition coils 12 and 13 is connected to the corresponding spark plug 18 and 19 of the first and second cylinders of the engine. Also, the other end of each primary coil of ignition coils 12 and 13 is supplied with voltage $V_b$ from battery 20 through an ignition switch 21.

Figure 2:
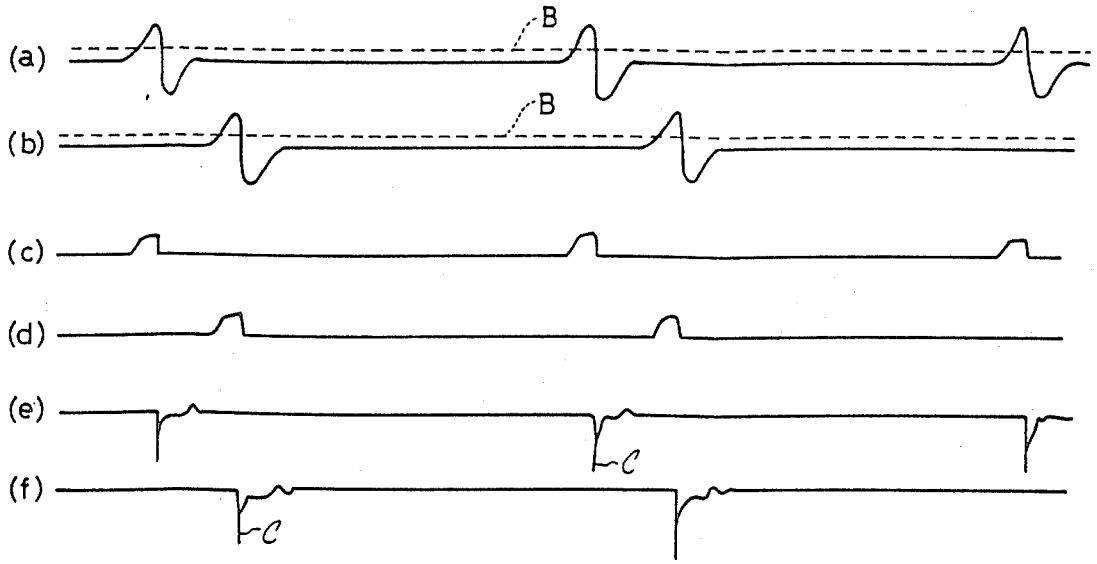
FIG. 2 PRIOR ART
FIG. 2 shows waveforms pertaining to the circuit of FIG. 1.

In this system, one cycle of an almost sine wave shaped pulse signal (a) and (b) is generated in order as shown in FIGS. 2(*a*) and (*b*) from magnet pick-up 4 and 5 when the crankshaft 1 revolves in the direction of arrow A. Pulse signal (b) is generated from magnetic pick-up 5 at the point that crankshaft 1 revolves 90 degrees from the generation of pulse signal (a) from magnet pick-up 4. Pulse signal (a) is generated again when the crankshaft 1 revolves another 270 degrees. Pulse signal (a) becomes a positive pulse (c) as shown in FIG. 2(*c*) after being differentiated by resistor 8 and condenser 9, and the negative voltage portion is clipped by diode 10. Current flows instantaneously in the primary coil of ignition coil 12 since this positive pulse turns on transistor 11. Therefore, high voltage pulse (e) is generated in the secondary coil as shown in FIG. 2(*e*) and a spark is provided at spark plug 18 of the first cylinder. In the same manner, pulse signal (b) obtained from magnet pick-up 5 is differentiated and clipped by ignition driving circuit 7, and a positive pulse (d) is supplied to the base of transistor 17 as shown in FIG. 2(*d*). Therefore, high voltage pulse (f) is generated in the secondary coil of ignition coil 13 as shown in FIG. 2(*f*) and a spark occurs at spark plug 19 of the second cylinder. Dashed line B in FIGS. 2(*a*) and (*b*) denotes a threshold value, and transistors 11 and 17 turn on only when the level of pulse signals (a) and (b) are larger than such threshold value.

In this kind of existing ignition system, ignition in the second cylinder occurs after the crankshaft revolves 90 degrees from the ignition period of the first cylinder and ignition occurs at the point the crankshaft revolves 270 degrees more. This action is repeated. As a result, needless spark occurs on the dead point of exhaust on the exhaust stroke except on the dead point of piston compression. Usually, this spark on the point of exhaust is called "abandoned fire", and the spark resulting from the high voltage pulse denoted by symbol C in FIG. 2 becomes abandoned fire.

An ignition system which prohibits generation of this kind of abandoned fire is discussed in Japanese Pat. No. 85227 (1978). In this kind of ignition system, a sine wave alternating signal is generated as one cycle while the crankshaft revolves 2n (n: natural number), and the ignition in the negative half wave part of this alternating signal is prohibited. When this ignition system is applied to the V type engine, it is easy to prohibit the generation of abandoned fire by installing an alternating signal generation circuit for each cylinder, but this system is expensive. Also when abandoned fire would be prohibited by using only a single alternating signal generation circuit, the cycle of the alternating signal is short. As shown In FIGS. 2(*c*) and (*d*), it becomes very difficult to prohibit providing the other side of the positive pulse to the transistor for preventing the generation of abandoned fire while igniting one side by supplying one positive pulse with a 90 degree phase difference at the revolution angle of the crankshaft to the transistor. There are more difficulties when the V angle between cylinders of the engine is reduced to an acute angle such as 52 degrees or 45 degrees.

THE PRESENT INVENTION

The present invention provides an ignition system for 4 cycle V type combustion engines which can prohibit generation of abandoned fire at low cost.

An ignition system of this invention is characterized by the following features: The first pulse is generated when the crankshaft revolves by a first setting angle from a base position. The second pulse is generated when the crankshaft revolves to a second setting angle which is larger than the first setting by the angle difference between the cylinders. The third pulse is generated at the position of a third setting angle which is between the first setting angle and the second setting angle in the position of the crankshaft when the crankshaft revolves twice. The generation of the first and second pulses is stopped or inhibited during the generation of the third pulse to allow the fade of first pulse to fade away.

An embodiment of this invention will be explained with reference to FIGS. 3 and 4.

Figure 3:
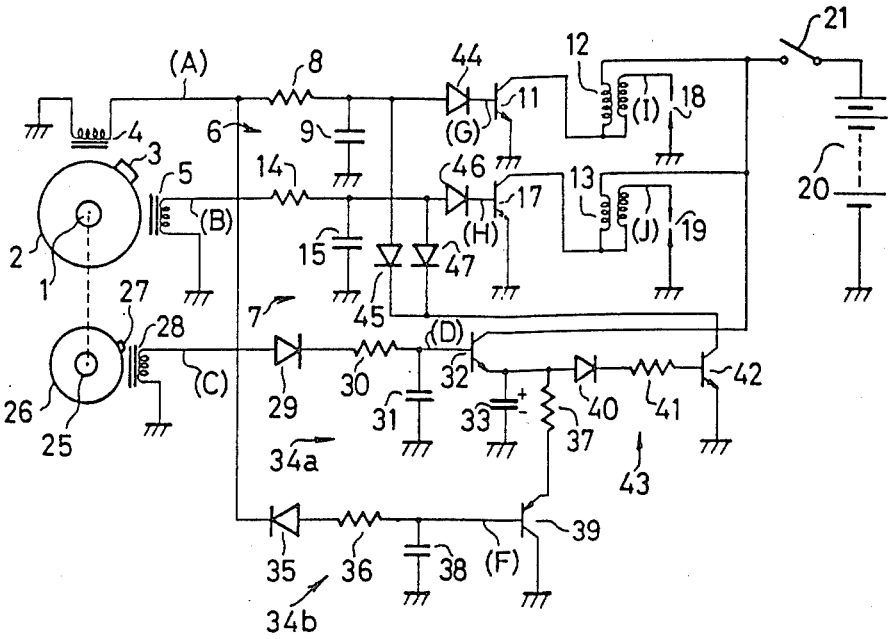
FIG. 3 shows a preferred embodiment of the present invention.
Figure 4:
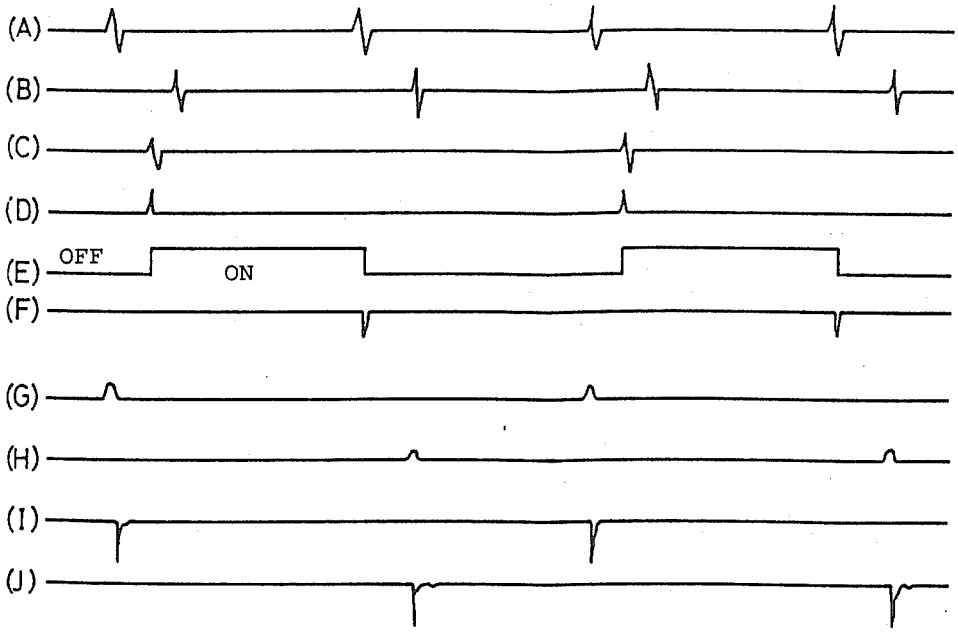
FIG. 4 shows waveforms pertaining to the circuit of FIG. 3.

In FIG. 3, the parts in FIG. 2 are denoted with the same symbols used earlier. An iron piece 27 is mounted convexly on a rotor 26 which is connected directly to the cam shaft 25 of the engine. A magnet pick-up 28 is mounted near rotor 26 and arranged to be directly opposite to the iron piece 27 when the cam shaft 25 is at the position which sets the revolution angle. A charging circuit 34*a* comprising a diode 29, resistor 30, condenser 31 and NPN transistor 32 is connected to the output terminal of magnet pick-up 28. In the charging circuit 34*a*, diode 29 picks up a positive voltage part of the output pulse signal of magnet pick-up 28, and resistor 30 and condenser 31 differentiate this signal and supply it to the base of the transistor 32. The collector of transistor 32 is connected to the ignition switch 21 and to the conjunction line of ignition coils 12 and 13. The emitter is connected to a charging and discharging condenser 33, and a voltage $v_b$ is supplied at the upper side or plate of condenser 33 when transistor 32 is on. Discharging circuit 34*b* which discharges condenser 33 comprises a diode 35, resistors 36 and 37, condenser 38 and PNP transistor 39. Diode 35 picks up a negative voltage part of the output pulse signal of magnet pick-up 4, and resistor 36 and condenser 38 differentiate and provide a signal to the base of transistor 39. The collector of transistor 39 is grounded.

The emitter of transistor 39 is connected to emitter of transistor 32, and to one side (the upper plate) of condenser 33 through resistor 37. This side of condenser 33 is connected to a switch circuit 43 which comprises a diode 40, resistor 41 and NPN transistor 42. The voltage of condenser 33 is supplied to the base of transistor 42 through diode 40 and resistor 42. The emitter of transistor 42 is grounded. The collector of transistor 42 serves as an output terminal of switch circuit 43.

A diode 44 is provided between transistor 11 and the output of the differential circuit which includes a resistor 8 and condenser 9 of ignition driving circuit 6. The anode side of diode 44, e.g., the differential circuit output, is connected to the collector of transistor 42 through the positive direction of diode 45. In the same manner, ignition driving circuit 7 has diodes 46 and 47. Diodes 44 and 46 are used to avoid a voltage drop resulting from diodes 45 and 47. Another feature of the ignition system of this embodiment is the elimination of the diodes 10 and 16 of the FIG. 1 circuit.

In this embodiment of an ignition system of this invention, pulse signals (A) and (B) are generated from magnet pick-ups 4 and 5 as shown in FIGS. 4(A) and (B) as before. On the other hand, the magnet pick-up 28 generates only one cycle of omitted sine wave pulse signal, FIG. 4(C), each time the cam shafted revolves one time. The crankshaft 1 revolves twice while the engine moves one cycle (4 strokes). Since sequentially connected cam shaft 25 revolves one time, the generation duration of pulse signal (c) denotes 1 cycle period of engine. Pulse signal (c) occurs during the fade away of pulse signal (A) corresponding to the dead point of compression to the generation of pulse signal (B) corresponding to the dead point of exhaust.

Pulse signal (c) becomes a charge pulse (D) of positive voltage as shown in FIG. 4(D) by diode 29, resistor 30 and condenser 31, e.g., the third pulse. This charge pulse (D) turns on transistor 32. Voltage $V_b$ is applied to the condenser 33 by turning on of transistor 32, and the condenser 33 is charged. Since this voltage is supplied to the base of transistor 42 through diode 40 and resistor 41, transistor 42 turns on as shown in FIG. 4(E). The voltage of condenser 33 is maintained above a certain voltage after fading away of the charging pulse (D).

If pulse signal (A) corresponding to the dead point of exhaust is generated in this state, pulse signal (A) becomes discharge pulse (F) of negative voltage as shown in FIG. 4(F) by diode 35, resistor 36 and condenser 38. This discharge pulse (F) turns on transistor 39. By turning on transistor 39, current from condenser 33 flows to ground through resistor 37 and transistor 39. Therefore, condenser 33 is discharged, and the voltage of condenser 33 goes down and below the certain voltage and turns off transistor 42.

Even if pulse signals (A) and (B) are generated during the "ON" period of transistor 42, the positive pulse, e.g., the first or second pulse, flows to ground through diode 45 or 47 and transistor 42. Thus, this pulse cannot turn on switches 11 or 17. Positive pulses (G) and (H) as first and second pulses which are shown in FIGS. 4(G) and (H) are supplied to the base of transistors 11 and 17 which only are corresponding pulse signals (A) and (B) generated during the "OFF" period of transistor 42, and transistors 11 and 17 turn on. High voltage pulse (I) which generates a spark on ignition plug 18 while transistor 11 is "ON" is generated in the secondary coil of ignition coil 12 as shown in FIG. 4(I). In the same manner, high voltage pulse (J) which generates a spark on ignition plug 19 while transistor 17 is "ON" is generated in the secondary coil of ignition coil 13 as shown in FIG. 4(J).

It should be noted that although the revolution angle position of the cam shaft is detected magnetically in this example, it is possible to detect it optically. Also, in this embodiment, the duration between the generation point of the third pulse to the fade away point of first pulse is detected with the charge-discharge circuit of the condenser and switching circuit, but detection using a flip-flop is also suitable.

According to the ignition system in this invention and the above-described embodiment, the first and second pulses are prohibited from supply to the spark ignition system during the occurrence of the third pulse and fading of the first pulse. This action prevents abandoned firing because the V angle of cylinders in a 4 cycle V type engine is an acute angle. It also has the advantage of low cost, and prevents abandoned fire with the third pulse generation method and it is a simple circuit. This invention can be applied to the ignition system of V type engine of different numbers of cylinders.

Figure 5:
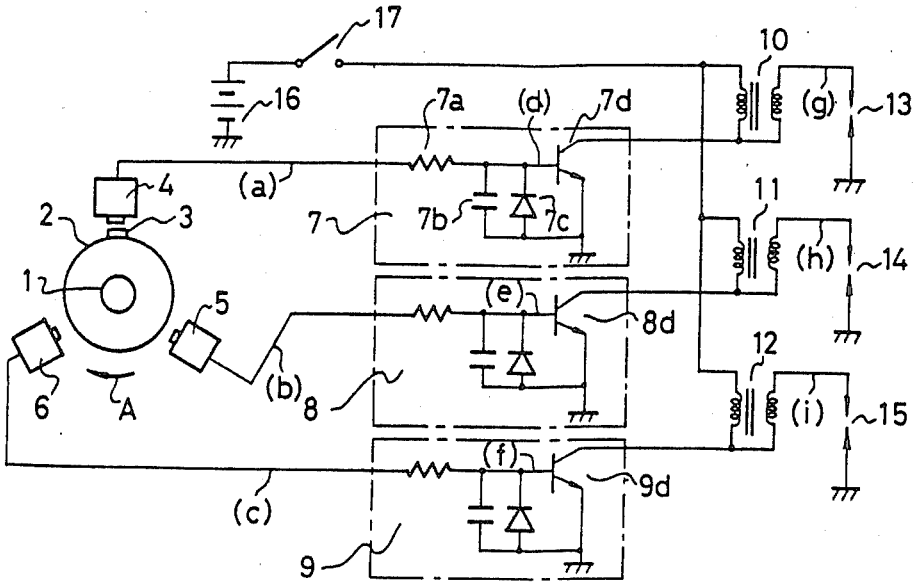
FIG. 5. PRIOR ART
FIGS. 5 and 6 show another form of existing ignition circuit and its waveforms.

FIG. 5 shows another existing ignition system used in motorcycles and which has a 3 cylinder, 4 cycle engine. The reference numerals discussed below pertain to FIGS. 5–8 only and in some instances are the same numerals previously used but do not necessarily correspond to the same parts in FIGS. 1–4. In this system, a iron piece is fixed convexily to rotor 2 when is connected to the crank shaft of the engine. Magnetic pick-ups 4–6 are mounted apart an equal angular distance. In revolving the rotor 2, which the iron piece 3 passes near magnetic pick-ups 4–6, a pulse signal is generated from the magnetic pick-ups 4–6. Ignition driving circuits 7–9 are connected to the output terminal of each respective magnetic pick-up 4–6. Ignition driving circuit 7 includes resistor 7*a*, condenser 7*b*, diode 7*c* and transistor 7*d*. An input pulse signal is differentiated by resistor 7*a* and condenser 7*b*, and that differentiated output is supplied to the base of transistor 7*d*. Diode 7*c* protects the transistor against a negative voltage input. The emitter of transistor 7*d* is connected to a ground. The collector provides the output terminal of the ignition driving circuit 7 and that output terminal is connected to one side of a primary and secondary coil of an ignition coil 10. Ignition driving circuits 8 and 9 are constructed the same as ignition driving circuit 7, and also the output terminal of ignition driving circuits 8 and 9 are connected to one side of primary and secondary coils of the ignition coils 11 or 12. Spark plugs 13, 14 and 15 for each respective cylinder are connected to the other end of secondary coils of the ignition coils 10, 11 and 12. A voltage $v_b$ from a battery 16 through an ignition switch 17 is provided to the other end of the primary coils of ignition coils 10, 11 and 12.

Figure 6:
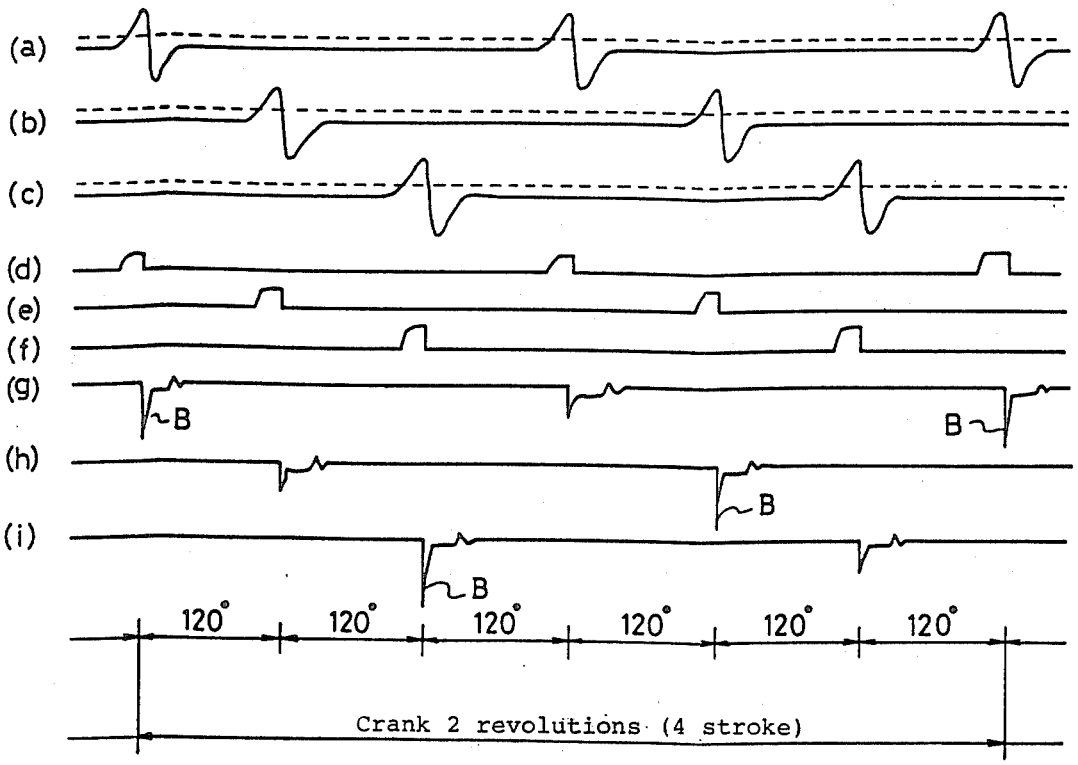
FIG. 6. PRIOR ART

In this system, every time the crankshaft 1 of the engine revolves 120 degrees in the direction of the arrow A, pulse signals (a), (b) and (c) of almost sine wave form are generated and which describe only one cycle of ignition timing as shown in FIGS. 6(*a*), (*b*) and (*c*) in the order of magnetic pick-up 4, 5, and 6. Pulse signal (a) is differentiated by resistance *7a* and condenser *7b*, and the negative voltage portion is cut off by diode *7c*. Therefore, the pulse signal is shown as positive pulse (d) as shown in FIG. 6(*d*). This positive pulse turns on transistor *7d* and, therefore, current flows instantly in the primary coil of ignition coil 10. Therefore, a high voltage pulse (g) is generated on the secondary coil as shown in FIG. 6(*g*) and there is a spark on the ignition or spark plug 13. Similarly, pulse signals (b) and (c) which are obtained at magnetic pick-up 5 and 6 are differentiated and cut off in the ignition driving circuit 8–9, and positive pulses (e) and (f) as shown in FIGS. 6(*e*) and (*f*) are provided at the base of transistors 8*d* and 9*d*. Thus, high voltage pulses (h) and (i) are generated on the secondary coil of ignition coils 11 and 12 as shown in FIGS. 6(*h*) and (*i*) and there are sparks at ignition plugs 14 and 15.

In the usual ignition system, the ignition is performed when the crankshaft moves every one revolution with the 120 degree phase difference between each other in each cylinder. In case of a 3 cylinder 4 cycle engine, there are some needless ignition sparks at the dead point of exhaust on the exhaust stroke except on the dead point of piston compression since it is sufficient that ignition occurs every 2 revolutions of the crankshaft with a 240 degree phase difference on each cylinder. Usually this spark on the point of exhaust is called "abandoned fire" and the spark which results from the high voltage pulse designated by the letter B in FIGS. 6(*g*)–(*h*) will be abandoned fire. However, when this kind of abandoned fire occurs, the ignition coil becomes overheated. Therefore, it is necessary to use large and heavy ignition coils with a large heat capacity.

Accordingly, it also is a feature of this invention to provide an ignition system which can use a small ignition coil by preventing the occurrence of abandoned fire.

The features of this embodiment of the ignition system may be summarized as follows. The first pulse is generated every time when the crankshaft of the engine moves 360°/n (where n is the number of cylinders) from the initial position. The first pulse is counted by using the counter. A second pulse is generated just before the ignition period of the base cylinder and the counting value of the counter is reset to the initial value. The corresponding cylinder is ignited by the first pulse using a logic gate method when the counting value of the counter matches the set value of the corresponding cylinder.

An example of this embodiment is described below with reference to FIGS. 7 and 8.

Figure 7:
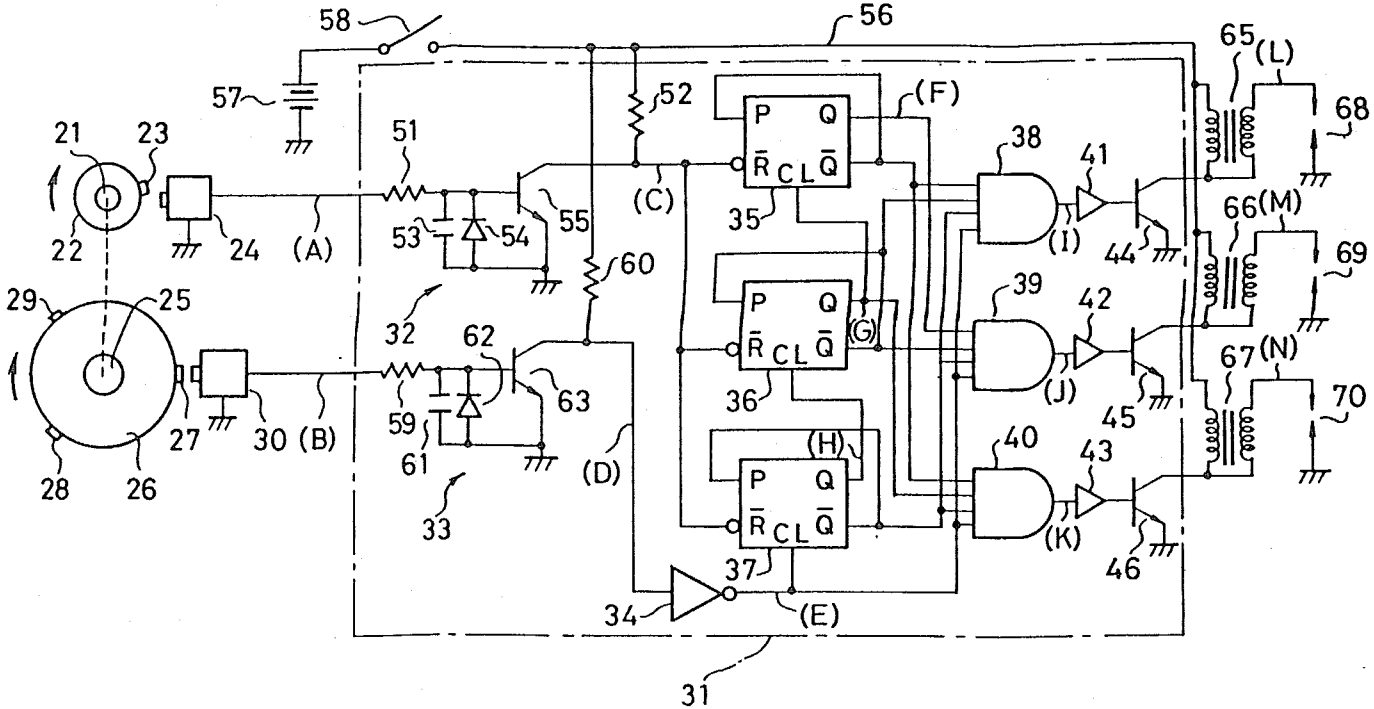
FIGS. 7 and 8 show another embodiment of the present invention and its waveforms.

The ignition system for a 3 cylinder 4 cycle engine is shown in FIG. 7. A single piece of iron 23 is mounted convexily on the rotor 22 which is connected directly to the cam shaft 21 of the engine. A magnetic pick-up 24 is mounted near the rotor 22 so that when the cam shaft 21 is positioned at the designated revolving angle the pick-up 24 is directly opposed to the iron piece 23. Three iron pieces 27, 28 and 29 are mounted convexly with equal angular distance around rotor 26 which is connected directly to crankshaft 25. Magnetic pick-up 30 is mounted near the rotor 26 so it is connected magnetically to the magnets 27, 28 and 29, when the crankshaft 25 revolves. Ignition driving circuit 31 is connected to the output terminal of magnetic pick-ups 24 and 30.

Ignition driving circuit 31 comprises a waveform rectifying circuit 32 and 33, inverter 34, D-flip flops 35 and 37, AND circuits 38 and 40, buffer amps 41 and 42 and driving transistors 44 and 46. Waveform rectifying circuit 32 comprises resistor 52 and 52, condenser 53, diode 54 and transistor 55. The output signal of the magnetic pick-up 24 is supplied to the base of transistor 55 through differential circuit comprising resistor 51 and condenser 53. The emitter of transistor 55 is grounded and diode 54 is provided for transistor protection against negative voltage input between base and emitter of transistor 55. The collector of transistor 55 is connected to the power line 56 through resistor 52. Voltage $V_b$ us supplied to the power line 56 from a battery 57 through ignition switch 58. The output terminal of waveform rectifying circuit 32 is provided by the collector of transistor 55, and this output terminal is connected to the reset terminals $\overline{R}$ of flip-flops 35 and 37. Input terminal P and outpput terminal $\overline{Q}$ of flip-flops 35 37 are connected directly together. Output terminal Q of flip-flop 37 is connected to the clock terminal CL of flip-flop 36, and output terminal Q of flip-flop 36 is connected to the clock terminal CL of flip-flop 35.

Waveform rectifying circuit 33 comprises resistors 59 and 60, condenser 61, diode 62, and transistor 63 and it is the same as the waveform rectifying circuit 32. The output signal from the magnetic pick-up 30 is provided to the waveform rectifying circuit 33. The output terminal of the waveform rectifying circuit 32 is connected to the clock terminal CL of the flip-flop 37 through inverter 34. An AND circuit 38 takes the logic sum of the output level of output terminal $\overline{Q}$ of flip-flop 35 or 37, and inverter 34. AND circuit 39 takes the logic sum of output level of output terminal Q of flip-flop 35, each output terminal $\overline{Q}$ of flip-flops 36 and 37 and inverter 34. In addition to this, AND circuit 40 takes the logic sum of the output level of each output terminal $\overline{Q}$ of flip-flops 35 and 37, output terminal Q of flip-flop 36 and inverter 34. The output terminal of AND circuit 38 is connected to the base of driving transistor 44 through buffer amp 41. The emitter of transistor 44 is grounded and the collector is connected to one side of the primary and secondary coil of ignition coil 65 as a first output terminal of ignition driving circuit 31. Both AND circuits 39 and 40 are connected as above. The collector of transistor 45 is connected to the primary and secondary coil of ignition coil 66 as a second output terminal of ignition driving circuit 31. Also the collector of transistor 46 is connected to one side of the primary and secondary coil of ignition coil 67 as a third output terminal. The other ends of ignition coils 65 and 67 are connected to the power line 56 and also the other end of the secondary coil is connected to the spark plugs 68 and 70 of corresponding cylinders.

In the ignition system of FIG. 7, magnet pick-up 24 generates only one cycle of omitted sine wave form pulse signal (A) as shown in FIG. 8A when the cam shaft moves one revolution. Also magnetic pick-up 30 generates only one cycle of omitted sine wave form pulse signal (B) as shown in FIG. 8(B) every time when the crankshaft 25 moves 120 degrees revolution. The crankshaft 25 revolves twice while the engine performs one cycle (4 stroke), and the cam shaft which also is connected to the engine revolves once. Therefore, the generating duration of pulse signal (A) denotes one cycle period of the engine.

Pulse signal (A) from the magnet pick-up 24 is differentiated by resistor 51 and condenser 53, and the negative voltage portion is cut off by diode 54 and becomes only a positive pulse. In addition to this, transistor 55 is turned on by this positive pulse during the period the level of pulse signal (A) is larger than the threshold value denoted by dashed line C in FIG. 8(A). At the output terminal of the waveform rectifying circuit 32, a negative square shaped pulse (C) is generated by the turning on of transistor 55 as shown in FIG. 8(C). Also, pulse signal (B) from the magnet pick-up 30 is rectified by waveform rectifying circuit 33, and a negative square shaped pulse (D) is generated as shown in FIG. 8 during the period the level of pulse signal (B) is larger than the threshold value denoted by dashed line D in FIG. 8(B). The generation time of the square pulse (C) is set to occur at just after the fade of square pulse (D) which is one half cycle before the generation time of square pulse (D) which denotes spark timing of the first cylinder.

Square pulse (C) provided as an output from waveform rectifying circuit 32 is supplied to each reset terminal $\overline{R}$ of flip-flop 35 and 37 as a second pulse. Square pulse (D) provided as an output from waveform rectifying circuit 33 is converted by inverter 34 into a positive square pulse (E) as shown in FIG. 8(E). Square pulse (E) is supplied to the clock terminal CL of flip-flop 37 as a first pulse. Flip-flops 35 and 37 read the input level of terminal P at the falling edge of the pulse which is supplied to the clock terminal CL and make an output level to output terminal Q and its coverting level to output terminal $\overline{Q}$. When the reset terminal $\overline{R}$ is a low level, the flip-flop is set to reset and makes output terminal Q go to a low level and $\overline{Q}$ go to a high level. According to this, flip-flops 35 and 37 are reset because the square pulse (C) is a low level.

When the square pulse (E) gets into the clock terminal CL of flip-flop 37 as an input, output terminal Q of flip-flop 37 goes to a low level and output terminal $\overline{Q}$ goes to a high level at its falling edge position. As this high level is supplied into input terminal P, the output terminal Q of flip-flop 37 goes to a high level and output terminal $\overline{Q}$ goes to a low level at the falling edge of the next square pulse (E). The flip-flop 37 works as if it were a binary counter, and level (F) of output terminal Q changes as shown in FIG. 8(F). Also, flip-flops 35 and 36 are constructed the same as flip-flop 37, and they each work as a binary counter, respectively. Level (F) of output terminal Q of flip-flop 37 is supplied to the clock terminal CL of flip-flop 36. Therefore, level (G) of output terminal Q of flip-flop 36 changes as shown in FIG. 8(H). Therefore, hexanary counter operation can be obtained by flip-flops 35 through 37.

When the output terminal $\overline{Q}$ of flip-flops 35 through 37 are at a high level, e.g., the counting value of the hexanary counter shows "000", the output level (I) of AND circuit 38 during the generation period of square pulse (E) becomes high level as shown in FIG. 8(I). When the output terminal $\overline{Q}$ of flip-flops 35 and 37 and the output terminal Q of flip-flop 36 are high, e.g., the counting value of hexanary counter shows "010", the output level (K) of AND circuit 40 during the generation period of square pulse (E) becomes a high level as shown in FIG. 8(K). When the output terminal Q of flip-flop 35 and output terminal $\overline{Q}$ of flip-flops 36 and 37 are high, e.g., the counting value of hexanary counter is "100", the output level (J) of AND circuit 39 during the generation period of square pulse (e) becomes high level as shown in FIG. 8(J). Once the output level (I) of AND circuit 38 becomes a high level, the output level (K) of AND circuit 40 becomes a high level after the crankshaft 25 revolves 240 degrees, and the output level (J) of AND circuit 39 becomes a high level after the crankshaft 25 revolves another 240 degrees. After that, if the crankshaft 25 revolves another 240 degrees, the n the output level (I) of AND circuit 38 becomes a high level again.

Each high level output from AND circuits 38 through 40 turns on corresponding transistors 44 through 46 through buffer amps 41, 42 or 43. When the transistor 44 turns on, the current flows instantaneously in the primary coil of ignition coil 65. This induces a high voltage pulse (L) on the secondary coil as shown in FIG. 8(L) and there is a spark at the ignition plug 68 of the first cylinder. In the same manner, high voltage pulses (M) and (N) are generated by the secondary coils of ignition coils 66 and 67 as shown in FIGS. 8(M) and (N) and there are sparks on ignition plug 69 of the second cylinder and ignition plug 70 of the third cylinder. Thus, there are sparks in the order of (1) the first cylinder, (2) the third cylinder and (3) the second cylinder, respectively, by a 240 degree phase difference in revolution angle of crankshaft 25 as shown in FIG. 8(O).

While, the revolution angle position of the cam shaft is detected magnetically in this embodiment, it is possible to detect optically. Also, it is possible to determine the stroke of the base cylinder from the pressure of the intake manifold of the entine. Furthermore, the ignition system of this embodiment can be applied to a 4 cycle engine with a different number of cylinders.

Figure 8:
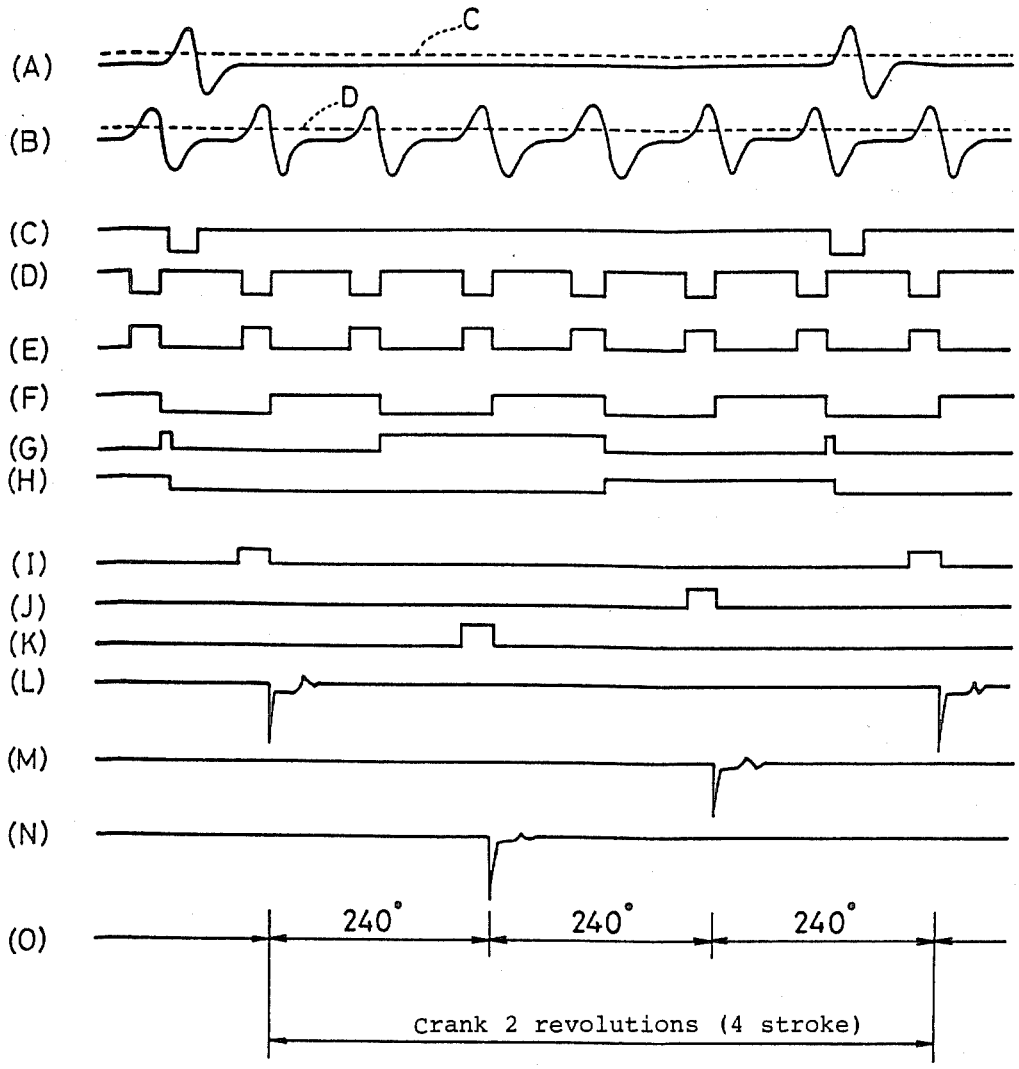

In summary, and according to the embodiment of FIGS. 7–8, the generation of abandoned fire is prohibited because no high voltage pulse is generated on the secondary coil of the ignition coil corresponding to the pulse signal generated at dead point of exhaust. As a result, the heat value of the ignition can be less compared to the existing ignition systems, and the ignition coil can be made small and light weight.

While preferred embodiments of the present invention have been illustrated and described, modifications and variations thereof will be apparent to those skilled in the art given the teachings herein, and it is intended that all such modifications and variations be encompassed with the scope of the appended claims.

What is claimed is:

1. An ignition system for a four cycle "V" type combustion engine having at least two cylinders and comprising first pulse generating means for generating first and second pulses, the first pulse being generated when a crankshaft of the engine revolves by a first setting angle from a base position and the first pulse including a first half-pulse and a second half-pulse whose polarities are different from each other, and the second pulse being generated when the crankshaft revolves by a second setting angle which is an angle greater than said first setting angle and is a function of the number of cylinders, second pulse generating means for generating a third pulse each time the crankshaft of the engine revolves twice and at a position that the crankshaft revolves by a third setting angle, said third setting angle being greater than said first setting angle but smaller than the second setting angle, ignition generating means for providing an ignition signal to at least one of the two cylinders in response to a first half-pulse and to provide an ignition signal to a second cylinder in response to a second pulse, voltage hold circuit means for developing a first charge state in response to a third pulse and for going to a second charge state in response to a second half-pulse, and means for prohibiting ignition generation for inhibiting a first half-pulse and second pulse from generating ignition signals depending on the charge/discharge state of said voltage hold circuit means during the period from a third pulse to a second half-pulse.

2. An ignition system as in claim 1 wherein said voltage hold circuit means includes a charging circuit which charges in response to each third pulse and discharges in response to predetermined second half-pulses.

3. An ignition system for a four cycle "V" type combustion engine having at least two cylinders and comprising first pulse generating means for generating first pulses and second pulses, the first pulses being generated when a crankshaft of the engine revolves by a first setting angle from a base position and the first pulses each including a first half-pulse and a second half-pulse whose polarities are different from each other, and the second pulses being generated when the crankshaft revolves by a second setting angle which is an angle greater than said first setting angle and is a function of the number of cylinders, second pulse generating means for generating a third pulse each time the crankshaft of the engine revolves twice and at a position that the crankshaft revolves by a third setting angle, said third setting angle being greater than said first setting angle but smaller than the second setting angle, ignition generating means for providing an ignition signal to at least one of the two cylinders in response to certain ones of the first half-pulses and to provide an ignition signal to a second cylinder in response to certain ones of the second pulses, voltage hold circuit means for developing a first charge state in response to the third pulses and for going to a second charge state in response to certain second half-pulses, and means for prohibiting ignition generation for inhibiting certain ones of the first half-pulses and certain ones of the second pulses from generating ignition signals depending on the charge state of said voltage hold circuit means during the period from a third pulse to a second half-pulse.

4. An ignition system for a four cycle "V" type combustion engine having at least two cylinders and comprising first pulse generating means for generating first and second pulses, the first pulse being generated when the crankshaft of the engine revolves by a first setting angle greater than said first setting angle and is a function of the number of cylinders, second pulse generating means for generating a third pulse each time the crankshaft of the engine revolves twice and at a position that the crankshaft revolves by a third setting angle, said third setting angle being greater than the first setting angle, but smaller than the second setting angle, ignition generating means responsive to the first and second pulses for providing an ignition signal to at least one of two cylinders corresponding to the first pulse and to provide an ignition signal to a second cylinder corresponding to the second pulse, charging circuit means and inhibit switch means, said charging circuit means being responsive to the third pulse for causing said inhibit switch means to go to a first state during which state ones of said first and second pulses are inhibited from initiating ignition signals to thereby prevent said ignition generating means from generating useless ignition signals during dead points of engine operation, and switch circuit means responsive to one of said first and second pulses for causing said inhibit switch means to switch to a second to enable ones of said first and second pulses to initiate, through the ignition generating means, ignition signals.

5. An ignition system as in claim 4 wherein said charging circuit means includes switching means responsive to the third pulse for allowing capacitor means to charge, the first and second states of said inhibit switch means respectively are "on" and "off," said inhibit switch means being turned "on" when said capacitor means reaches a predetermined charge for thereby passing to ground the first and second pulses occurring during the "on" state of said inhibit switching means, and said switch circuit means including switching means responsive to said first pulses for causing discharge of the capacitor means and turn "off" of said inhibit switch means whereby first and second pulses occurring during the "on" state of the inhibit switch means are bypassed and prevented from causing said ignition generating means to provide ignition signals.

* * * * *